US007821469B2

(12) United States Patent
Yu et al.

(10) Patent No.: US 7,821,469 B2
(45) Date of Patent: Oct. 26, 2010

(54) PRINTED ANTENNA

(75) Inventors: Zhi-Cheng Yu, Shenzhen (CN); Cho-Ju Chung, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 127 days.

(21) Appl. No.: 12/206,725

(22) Filed: Sep. 8, 2008

(65) Prior Publication Data

US 2009/0262026 A1 Oct. 22, 2009

(30) Foreign Application Priority Data

Apr. 16, 2008 (CN) ..... 2008 1 0301147

(51) Int. Cl.
*H01Q 1/38* (2006.01)

(52) U.S. Cl. ..... 343/828; 343/829; 343/833

(58) Field of Classification Search ..... 343/846, 343/848, 828, 829, 830, 831, 702, 700 MS, 343/833
See application file for complete search history.

(56) References Cited

U.S. PATENT DOCUMENTS 6,552,686 B2 * 4/2003 Ollikainen et al. .... 343/700 MS
7,113,135 B2 * 9/2006 Jo et al. ..... 343/702

FOREIGN PATENT DOCUMENTS

TW 200803053 1/2008

* cited by examiner

*Primary Examiner*—Michael C Wimer
*Assistant Examiner*—Kyana R Robinson
(74) *Attorney, Agent, or Firm*—Frank R. Niranjan

(57) ABSTRACT

A printed antenna is positioned on a substrate, and includes a feeding portion and a radiating portion. The feeding portion is configured for feeding electromagnetic signals. The radiating portion is electronically connected to the feeding portion for transceiving the electromagnetic signals, and includes a first radiator, a second radiator, and a guiding portion. The first radiator is electronically connected to the feeding portion, and includes an arc-shaped radiating section. The second radiator is electronically connected to the feeding portion and the first radiator. The guiding portion is arc-shaped. The guiding portion and the second radiator are respectively positioned on different sides of the first radiator. A space between the guiding portion and the arc-shaped radiating section of the first radiator defines a first slot.

12 Claims, 5 Drawing Sheets

270

PRINTED ANTENNA

BACKGROUND

1. Field of the Invention

Embodiments of the present disclosure relate to antennas, and particularly to a printed antenna.

2. Description of Related Art

Recently, there has been significant growth in wireless communication technology due to the growing demand for wireless communication devices, such as mobile phones and access points (AP).

Antennas are necessary components in wireless communication devices in order to radiate electromagnetic signals. In order for wireless communication devices to have a small size, printed antennas positioned within these wireless communication devices are required to have a reduced dimension, as well as have a high radiating performance.

SUMMARY

An exemplary embodiment of the present invention provides a printed antenna. The printed antenna is positioned on a substrate, and includes a feeding portion and a radiating portion. The feeding portion is configured for feeding electromagnetic signals. The radiating portion is electronically connected to the feeding portion for transceiving the electromagnetic signals, and includes a first radiator, a second radiator and a guiding portion. The first radiator is electronically connected to the feeding portion, and includes an arc-shaped radiating section. The second radiator is electronically connected to the feeding portion and the first radiator. The guiding portion and the second radiator are respectively positioned on different sides of the first radiator. A space between the guiding portion and the arc-shaped radiating section defines a first slot.

Other objectives, the advantages and novel features of the present invention will become more apparent from the following detailed description of preferred embodiment when taken in conjunction with the accompanying drawings, in which:

DETAILED DESCRIPTION

Figure 1:
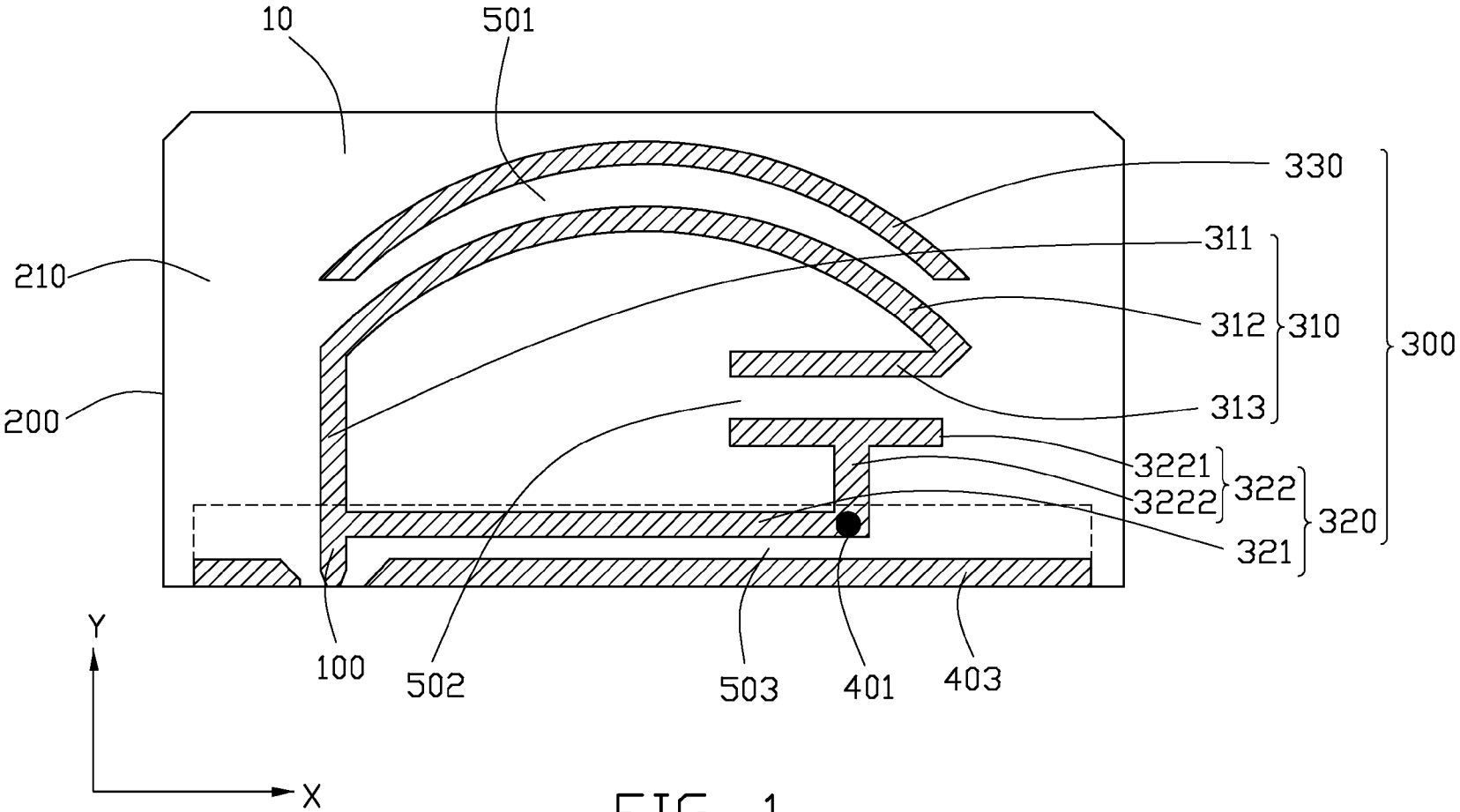
FIG. 1 is a plan view of a printed antenna in accordance with an exemplary embodiment of the present disclosure.
Figure 2:
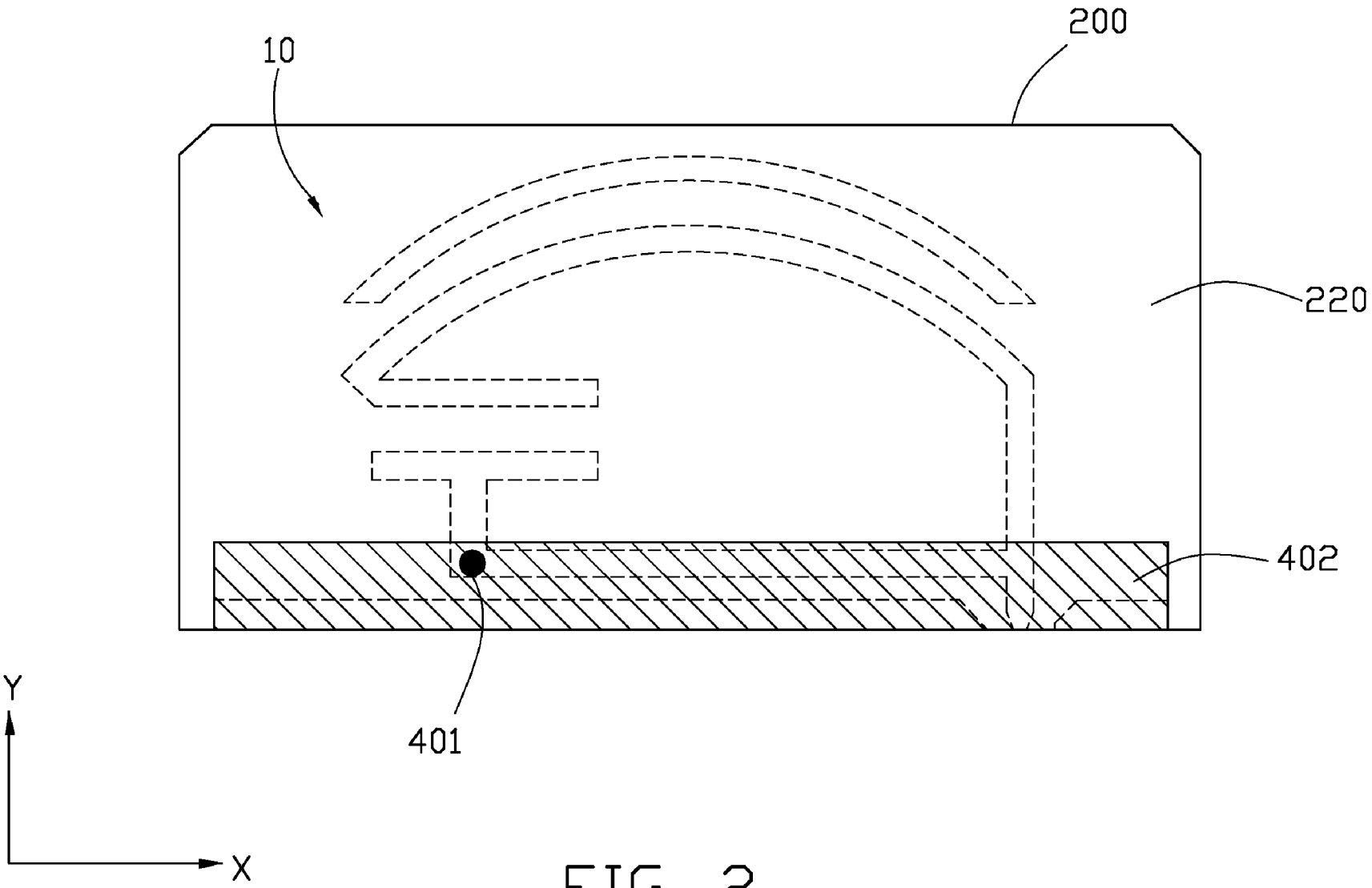
FIG. 2 is similar to FIG. 1, but viewed from another aspect.

FIG. 1 and FIG. 2 are schematic views of a printed antenna 10 in accordance with one embodiment of the present disclosure. The printed antenna 10 is positioned on a substrate 200, and includes a feeding portion 100 and a radiating portion 300. In the embodiment of FIGS. 1-2, the printed antenna 10 is a straight F antenna. The substrate 200 includes a first surface 210 and a second surface 220 opposite to the first surface 210. In one embodiment, the substrate may comprise a printed circuit board (PCB).

The feeding portion 100 is positioned on the first surface 210 for feeding electromagnetic signals. In one embodiment, the feeding portion 100 may have an elongated shape.

The radiating portion 300 is positioned on the first surface 210 for transceiving electromagnetic signals, and includes a first radiator 310, a second radiator 320, and a guiding portion 330.

The first radiator 310 is electronically connected to the feeding portion 100, and includes a first radiating section 311, a second radiating section 312, and an first matching section 313. In one embodiment, the feeding portion 100, the first radiating section 311, the second radiating section 312, and the first matching section 313 are electronically connected one by one in sequence. An extending direction of the first matching section 313 is perpendicular to that of the first radiating section 311.

In one embodiment, the guiding portion 330 may be contoured in the form of an arc having a concave down shape to the X-axis of the printed antenna 10. The guiding portion 330 and the second radiating portion 312 are contoured to define a first slot 501 positioned between the guiding portion 330 and the second radiating portion 312. In one embodiment, the guiding portion 330 may be homocentric with the second radiating section 312. The guiding portion 330 improves the radiation performance of the second radiating section 312.

In one embodiment, the guiding portion 330 and the second radiator 320 are respectively positioned on different sides of the first radiator 310.

The second radiator 320 is electronically connected to the feeding portion 100 and the first radiator 310. The second radiator 320 includes a third radiating section 321 and a fourth radiating section 322. In one embodiment, the third radiating section 321 may be electronically connected to the feeding portion 100 and the first radiator 311. Additionally, the third radiating section 321 may be substantially perpendicular to the feeding portion 100 and the first radiator 311. The fourth radiating section 322 includes a second matching segment 3221 and a connection segment 3222 that are electronically and perpendicular to connected to the middle part of the second matching segment 3221. The second matching segment 3221 is substantially parallel to the first matching section 313, which defines a second slot 502 between the first matching section 313 and the second matching segment 3221. The second slot 502 together with the second matching segment 3221 of the fourth radiating section 322 and the first matching section 313, form a capacitive load, thereby reducing the dimensions of the printed antenna 10.

The printed antenna 10 further comprises a first grounding portion 403 positioned on the first surface 210. The first grounding portion 403 is trapezium-shaped, and positioned on at least one side of the feeding portion 100. In one embodiment, a top side of the trapezium of the first grounding portion 403 is parallel to the third radiating section 321, which defines a third slot 503 between the first grounding portion 403 and the connection segment 3222.

In one embodiment, the printed antenna 10 further includes a second grounding portion 402 printed on the second surface 220. The substrate 200 defines a conductive hole 401 through the second surface 220 to the first surface 210. The conductive hole 401 electronically connects the third radiating section 321 and the fourth radiating section 322 to the second grounding portion 402.

Figure 3:
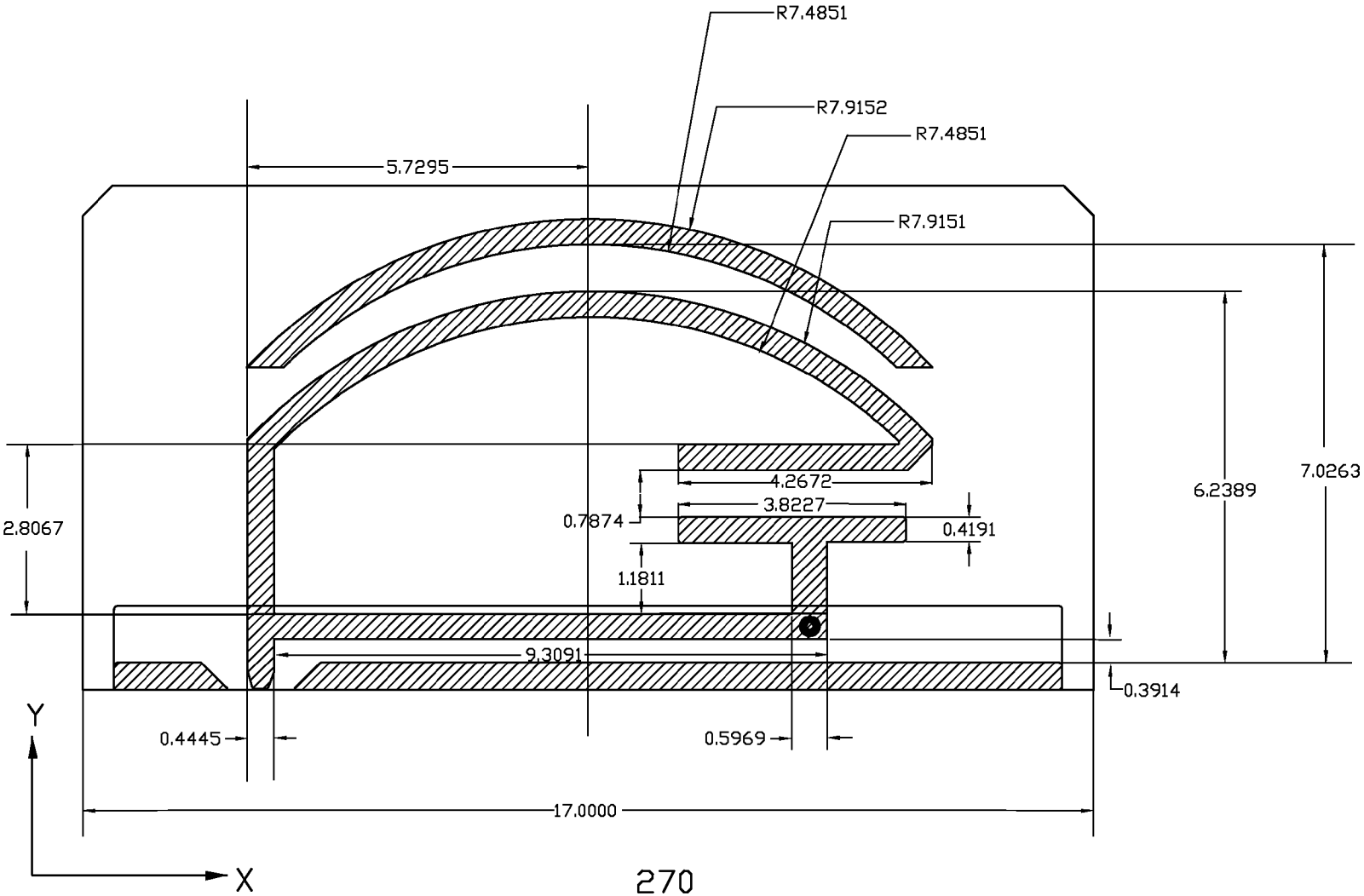
FIG. 3 illustrates one exemplary embodiment of the printed antenna of FIG. 1 illustrating exemplary dimensions.

FIG. 3 illustrates one exemplary embodiment of the printed antenna 10 of FIG. 1 illustrating exemplary dimensions. In one embodiment, the length of the substrate 200 is about 17 millimeters (mm). The width of the feeding portion 100 is about 0.4445 mm. The length of the first radiating section 311 is about 2.8067 mm, and the width of the first radiating portion is about 0.4445 mm. The outside radius of the second radiating section 312 is about 7.4851 mm, and the inside radius is about 7.9152 mm. The length of the first matching section 313 is about 4.2672 mm, and the width of the first matching section 313 is about 0.4191 mm. The length of the third radiating section 321 is 9.3091 mm, and the width of the third radiating section 321 is about 0.4191 mm. The length of the connection segment of the fourth section 322 is about 1.1811 mm, and the width of the fourth section 322 is about 0.569 mm. The length of the second matching segment of the fourth section 322 is about 3.8227 mm, and the width of the fourth section 322 is about 0.4191 mm. The outside radius of the guiding portion 330 is about 7.4851 mm, and the inside radius is about 7.9151 mm. The distance from the top point of the guiding portion 330 to the first grounding portion 403 is about 7.0263 mm. The distance from the top point of the second radiating section 312 to the first grounding portion 403 is about 6.2389 mm. The distance from the first matching section 313 to the fourth radiating section 322 is about 0.7874 mm. The distance from the third radiating section 321 to the first grounding portion 403 is about 0.3914 mm. It may be understood that the embodiment of FIG. 3 is exemplary and many variations and dimensional changes may be made without departing from the spirit of the present disclosure.

Figure 4:
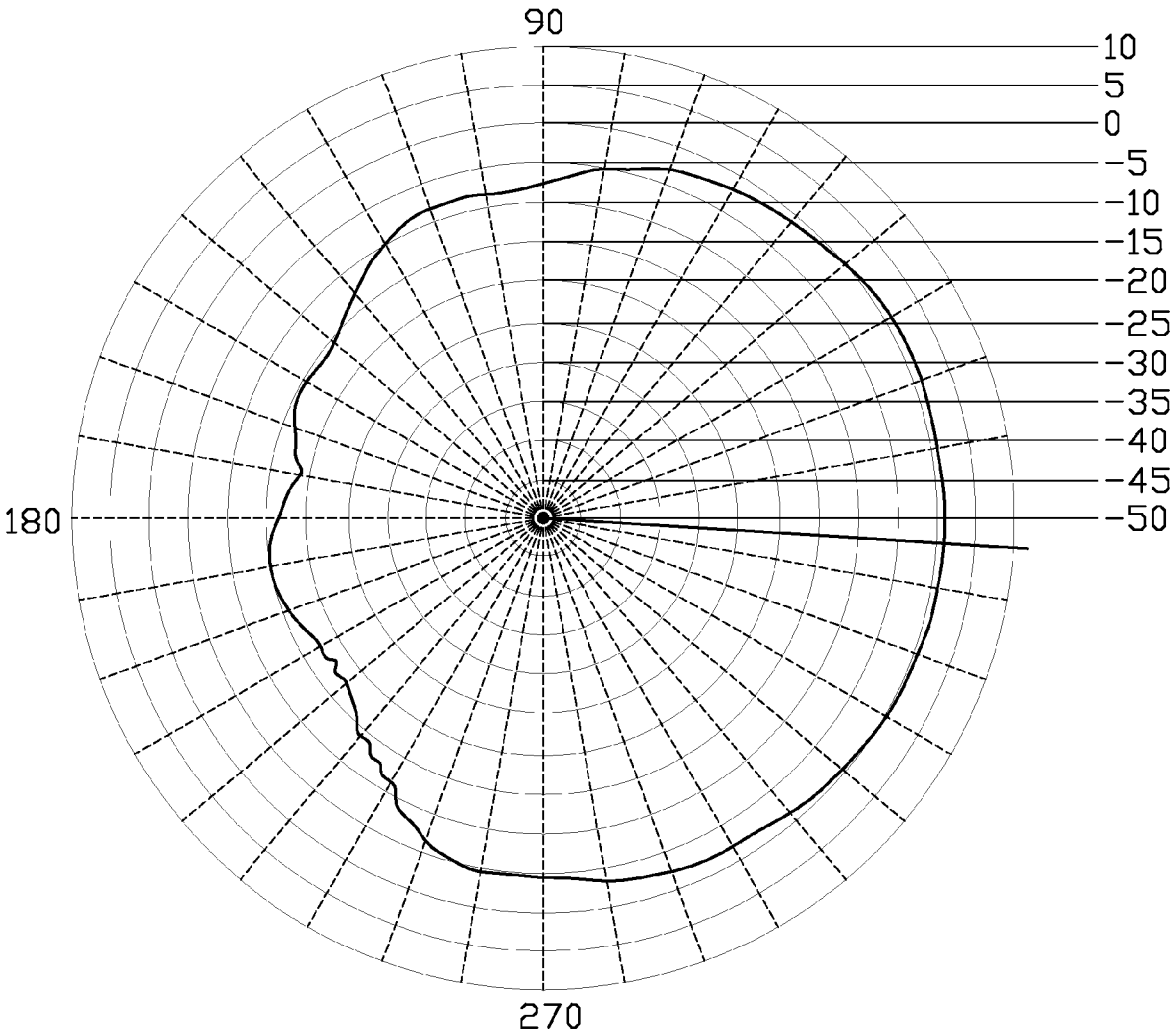
FIG. 4 is a test chart showing exemplary radiation patterns on X-Y plane when the printed antenna of FIG. 1 operates at the frequency of approximately 2.48 GHz.

FIG. 4 is a test chart showing an exemplary radiation pattern on an X-Y plane when the printed antenna 10 of FIG. 1 and FIG. 2 operates at a frequency of approximately 2.48 GHz.

Figure 5:
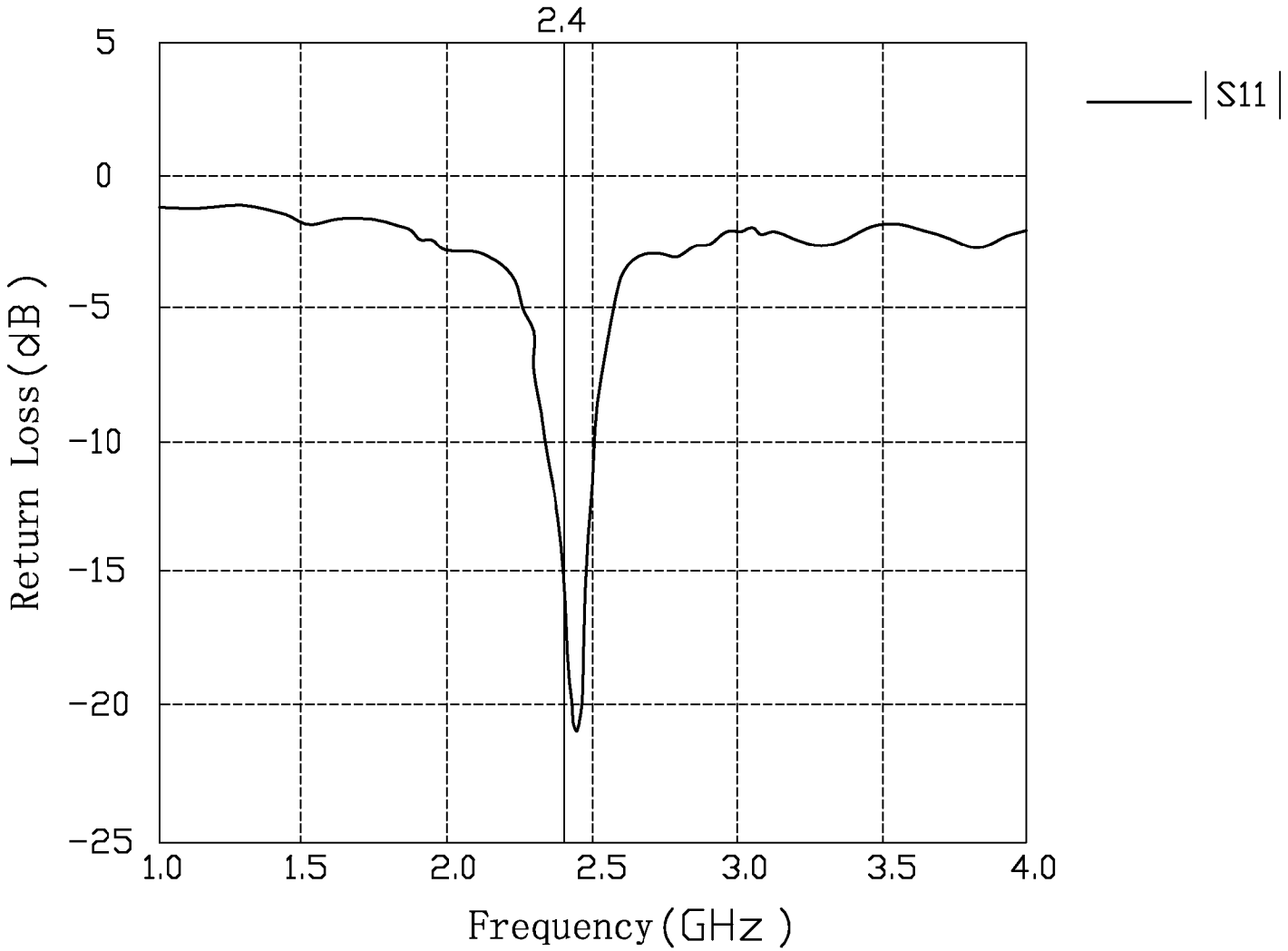
FIG. 5 is a graph showing one exemplary return loss of the printed antenna of FIG. 1.

FIG. 5 is a graph showing one exemplary return loss of the printed antenna 10 of FIG. 1 and FIG. 2. As shown, the return loss is less than −10 dB when the printed antenna 10 operates at a frequency of approximately 2.4 GHz.

The description of the present disclosure has been presented for purposes of illustration and description, and is not intended to be exhaustive or limited to the disclosure in the form disclosed. Many modifications and variations will be apparent to those of ordinary skill in the art. Various embodiment were chosen and described in order to best explain the principles of the disclosure, the practical application, and to enable others of ordinary skill in the art to understand the disclosure for various embodiments with various modifications as are suited to the particular use contemplated.

What is claimed is:

1. A printed antenna, positioned on a substrate, comprising:

a feeding portion for feeding electromagnetic signals; and a radiating portion electronically connected to the feeding portion for transceiving the electromagnetic signals, the radiation portion comprising:

a first radiator electronically connected to the feeding portion, the first radiator comprising an arc-shaped radiating section, the first radiator further comprises a first matching section and a first radiating section, wherein the first matching section electronically connected to one end of the arc-shaped radiating section, the first radiating section connected to the feeding portion and another end of the arc-shaped radiating section, and an extending direction of the first radiating section is perpendicular to that of the first matching section;

a second radiator electronically connected to the feeding portion and the first radiator, wherein the second radiator comprises a third radiating section perpendicular to and electronically connected to the first radiator, and a fourth radiating section electronically connected to the third radiating section; and a guiding portion, the guiding portion and the second radiator respectively positioned on different sides of the first radiator;

wherein a space between the guiding portion and the arc-shaped radiating section of the first radiator define a first slot.

2. The printed antenna as claimed in claim 1, wherein the guiding portion is arc-shaped and homocentric with the arc-shaped radiating section.

3. The printed antenna as claimed in claim 1, wherein the fourth radiating section comprises a second matching segment and a connection segment connected to the middle of the second matching segment.

4. The printed antenna as claimed in claim 3, wherein the second matching segment is substantially parallel to the first matching section so as to define a second slot between the second matching segment and the first matching section.

5. The printed antenna as claimed in claim 1, wherein the substrate comprises a first surface and a second surface opposite to the first surface.

6. The printed antenna as claimed in claim 5, wherein the feeding portion and the radiating portion are positioned on the first surface of the substrate.

7. The printed antenna as claimed in claim 6, further comprising a first grounding portion positioned on the first surface of the substrate.

8. The printed antenna as claimed in claim 7, wherein the first grounding portion is trapezium-shaped and positioned on at least one side of the feeding portion.

9. The printed antenna as claimed in claim 8, wherein a top side of the trapezium-shaped first grounding portion is paralleled to the third radiating section so as to define a third slot between the trapezium-shaped first grounding portion and the third radiating portion.

10. The printed antenna as claimed in claim 7, further comprising a second grounding portion positioned on the second surface of the substrate.

11. The printed antenna as claimed in claim 10, wherein a conductive hole is defined through the first surface to the second surface and electronically connected the third radiating section and the fourth radiating section to the second grounding portion.

12. The printed antenna as claimed in claim 1, wherein the substrate is a printed circuit board.

* * * * *